US010344632B2

(12) United States Patent
Smith

(10) Patent No.: US 10,344,632 B2
(45) Date of Patent: Jul. 9, 2019

(54) MULTI-MODE VARIABLE CAMSHAFT TIMING DEVICE WITH TWO LOCKING POSITIONS

(71) Applicant: BorgWarner Inc., Auburn Hills, MI (US)

(72) Inventor: Franklin R. Smith, York, SC (US)

(73) Assignee: BorgWarner Inc., Auburn Hills, MI (US)

( * ) Notice: Subject to any disclaimer, the term of this patent is extended or adjusted under 35 U.S.C. 154(b) by 94 days.

(21) Appl. No.: 15/714,469

(22) Filed: Sep. 25, 2017

(65) Prior Publication Data

US 2018/0073402 A1 Mar. 15, 2018

Related U.S. Application Data

(63) Continuation-in-part of application No. 15/146,520, filed on May 4, 2016, now Pat. No. 9,803,520, which is a continuation of application No. 14/840,683, filed on Aug. 31, 2015, now Pat. No. 9,695,716.

(60) Provisional application No. 62/527,629, filed on Jun. 30, 2017.

(51) Int. Cl.
*F01L 1/344* (2006.01)
*F01L 1/047* (2006.01)

(52) U.S. Cl.
CPC ..... *F01L 1/3442* (2013.01); *F01L 1/047* (2013.01); *F01L 1/34409* (2013.01); *F01L 2001/3443* (2013.01); *F01L 2001/34426* (2013.01); *F01L 2001/34433* (2013.01); *F01L 2001/34453* (2013.01); *F01L 2250/02* (2013.01); *F01L 2250/04* (2013.01); *F01L 2250/06* (2013.01)

(58) Field of Classification Search
CPC ..... F01L 1/3442; F01L 1/34409; F01L 1/047; F01L 2001/3443; F01L 2001/34433; F01L 2001/34453; F01L 2250/04; F01L 2250/06; F01L 2001/34426; F01L 2250/02
See application file for complete search history.

(56) References Cited

U.S. PATENT DOCUMENTS

| | | | | |
|---|---|---|---|---|
| 6,453,859 | B1 | 9/2002 | Smith et al. | |
| 7,434,554 | B2 | 10/2008 | Nagashima | |
| 7,946,266 | B2 | 5/2011 | Knecht et al. | |
| 2002/0139332 | A1* | 10/2002 | Takenaka | F01L 1/34 123/90.17 |
| 2016/0130988 | A1* | 5/2016 | Smith | F01L 1/3442 123/90.17 |

* cited by examiner

*Primary Examiner* — Mark A Laurenzi
*Assistant Examiner* — Wesley G Harris
(74) *Attorney, Agent, or Firm* — Brown & Michaels, PC

(57) ABSTRACT

A system including a phaser with a first lock pin and a second lock pin in the rotor assembly. The first and second locks pins having a locked position where they engage a recess in the housing assembly and an unlocked position in which they do not engage the housing assembly. The first lock pin locks the rotor assembly to the housing assembly when the phaser is in an intermediate phase angle position. The second lock pin locks the rotor assembly to the housing assembly when the phaser is at a full retard position. The control valve includes a recirculation check valve and an inlet check valve.

16 Claims, 9 Drawing Sheets

MULTI-MODE VARIABLE CAMSHAFT TIMING DEVICE WITH TWO LOCKING POSITIONS

REFERENCE TO RELATED APPLICATIONS

This application claims one or more inventions which were disclosed in Provisional Application No. 62/527,629, filed Jun. 30, 2017, entitled "VARIABLE CAMSHAFT TIMING DEVICE WITH TWO LOCKING POSITIONS". The benefit under 35 USC § 119(e) of the United States provisional application is hereby claimed, and the aforementioned application is hereby incorporated herein by reference.

This is a continuation-in-part of parent patent application Ser. No. 15/146,520, filed May 4, 2016, entitled "MULTI-MODE VARIABLE CAM TIMING PHASER", which is a continuation of U.S. Pat. No. 9,695,716 issued Jul. 4, 2017. The aforementioned applications are hereby incorporated herein by reference.

BACKGROUND OF THE INVENTION

Field of the Invention

The invention pertains to the field of variable camshaft timing mechanisms. More particularly, the invention pertains to a multi-mode variable camshaft timing mechanism with two lock positions.

Description of Related Art

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). Vane phasers have a rotor with one or more vanes, mounted to the end of the camshaft, surrounded by a housing assembly with the vane chambers into which the vanes fit. It is possible to have the vanes mounted to the housing assembly, and the chambers in the rotor assembly, as well. The housing's outer circumference forms the sprocket, pulley or gear accepting drive force through a chain, belt, or gears, usually from the crankshaft, or possible from another camshaft in a multiple-cam engine.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing, the rotor, and the vane. This creates a pressure differential across one or more of the vanes to hydraulically push the VCT phaser in one direction or the other. Neutralizing or moving the valve to a null position puts equal pressure on opposite sides of the vane and holds the phaser in any intermediate position. If the phaser is moving in a direction such that valves will open or close sooner, the phaser is said to be advancing and if the phaser is moving in a direction such that valves will open or close later, the phaser is said to be retarding.

The torsional assist (TA) systems operates under a similar principle with the exception that it has one or more check valves to prevent the VCT phaser from moving in a direction opposite than being commanded, should it incur an opposing force such as torque.

The problem with OPA or TA systems is that the oil control valve defaults to a position that exhausts all the oil from either the advance or retard working chambers and fills the opposing chamber. In this mode, the phaser defaults to moving in one direction to an extreme stop where the lock pin engages. The OPA or TA systems are unable to direct the VCT phaser to any other position during the engine start cycle when the engine is not developing any oil pressure. This limits the phaser to being able to move in one direction only in the engine shut down mode. In the past this was acceptable because at engine shut down and during engine start the VCT phaser would be commanded to lock at one of the extreme travel limits (either full advance or full retard).

Furthermore, by reducing the idling time of an internal combustion engine in a vehicle, the fuel efficiency is increased and emissions are reduced. Therefore, vehicles can use a "stop-start mode" which automatically stops and automatically restarts the internal combustion engine to reduce the amount of time the engine spends idling when the vehicle is stopped, for example at a stop light or in traffic. This stopping of the engine is different than a "key-off" position or manual stop via deactivation of the ignition switch in which the user of the vehicle shuts the engine down or puts the car in park and shuts the vehicle off. In "stop-start mode", the engine stops as the vehicle is stopped, then automatically restarts in a manner that is nearly undetectable to the user of the vehicle. In the past, vehicles have been designed primarily with cold starts in mind, since that is the most common situation. In a stop-start system, because the engine had been running until the automatic shutdown, the automatic restart occurs when the engine is in a hot state. It has long been known that "hot starts" are sometimes a problem because the engine settings necessary for the usual cold start—for example, a particular valve timing position—are inappropriate to a warm engine.

SUMMARY OF THE INVENTION

A system including a phaser with a first lock pin and a second lock pin in the rotor assembly. The first and second locks pins having a locked position where they engage a recess in the housing assembly and an unlocked position in which they do not engage the housing assembly. The first lock pin locks the rotor assembly to the housing assembly when the phaser is in an intermediate phase angle position. The second lock pin locks the rotor assembly to the housing assembly when the phaser is at a full retard position. The control valve includes a recirculation check valve and an inlet check valve.

DETAILED DESCRIPTION OF THE INVENTION

Figure 1:
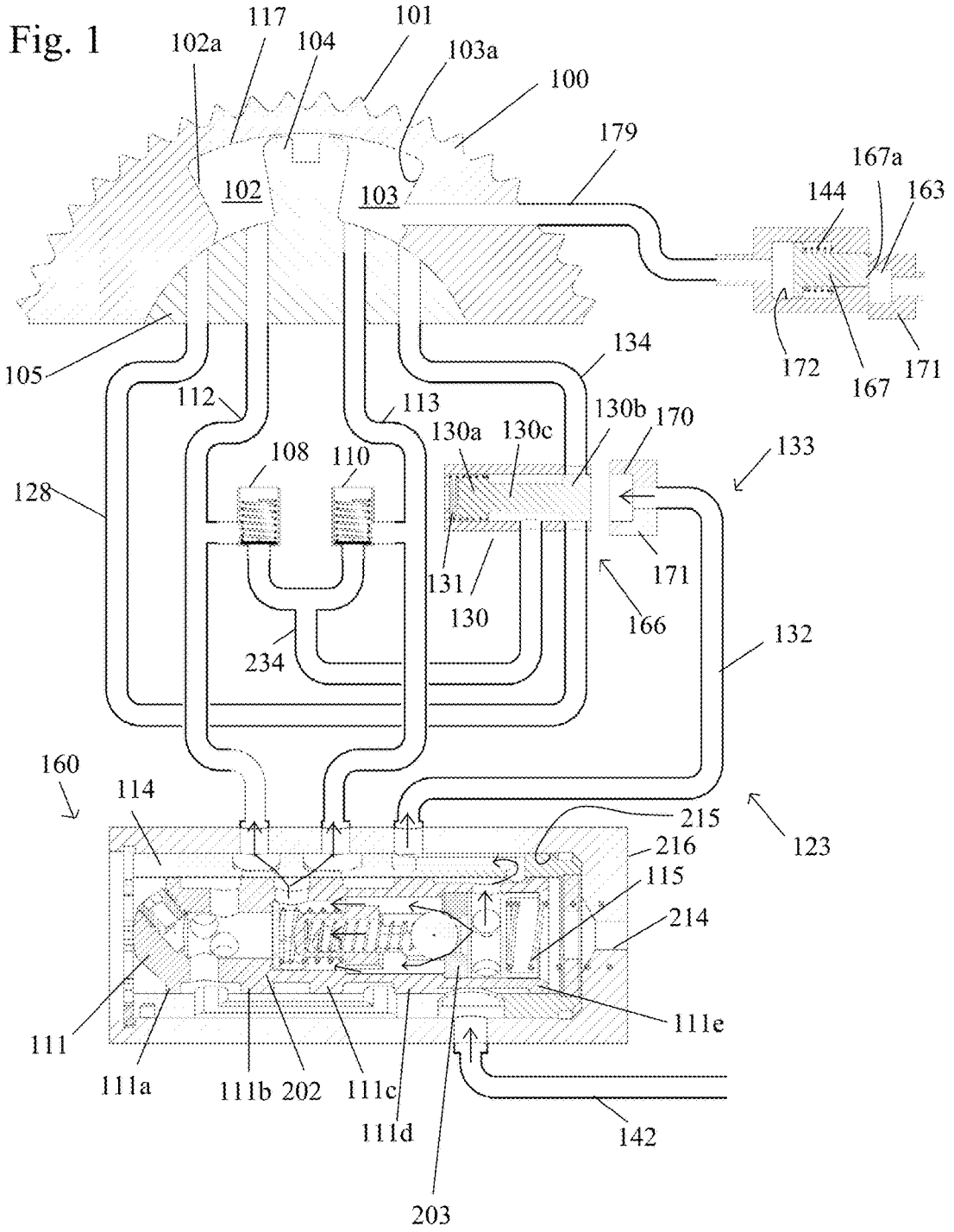
FIG. 1 shows a schematic of a variable cam timing phaser operating in a first state or mode of null position.

In the present invention, it is recognized that a single recirculation check valve and a single inlet check valve are used to accomplish multi-modes. Furthermore, the recirculation check valve and the inlet check valve are located internal to the control valve, which may reduce the radial package size.

The single inlet check valve and the single recirculation check valve may be the same type of check valve (plate type, ball type or disc type) or they may be different types of check valves.

Some of the embodiments of the present invention include a phaser which has an offset or remote piloted valve added to the hydraulic circuit to manage a hydraulic detent switching function, in order to provide a mid-position lock for cold starts of the engine, either during cranking or prior to complete engine shutdown. The mid-position locking of the phaser positions the cam at an optimum position for cold restarts of the engine once a current signal has been removed from the actuator, or variable force solenoid. The present invention also discloses locking the phaser in a full retard position during an automatic "stop" of the engine in stop-start mode.

The phasers of the present invention have two distinct, and separate locking positions which are easy to control and can be commanded to engage which corresponds to a first locking mode and a second locking mode. In one embodiment, a first lock pin corresponding to a first locking mode is controlled by control valve of the variable cam timing mechanism or phaser and the second lock pin which corresponds to a second locking mode is pressurized to engage and is controlled by pressure in a working chamber of the phaser, either the advance working chamber or the retard working chamber. Therefore, the phaser can be locked at a mid or intermediate position and an end position, either when the vane is at the advance end stop or the retard end stop. The first lock pin may be part of the detent valve of the phaser.

In a locked position, the first or second lock pins engage an outer end plate of the housing assembly of the phaser. Alternatively, the first or second lock pins engage the rotor assembly of the phaser when in a locked position.

In one embodiment, one of the lock pins is moved to a locked position when the phaser is in a full retard position and the other of the lock pins is moved to a locked position when the phaser is in a mid-position or intermediate phase angle. In an alternative embodiment, one of the lock pins is moved to a locked position when the phaser is in a full advance position and the other of the lock pins is moved to a locked position when the phaser is in a mid-position or intermediate phase angle. In yet another alternative embodiment, one of the lock pins is moved to a locked position when the phaser is in a full advance position and the other of the lock pins is moved to a locked position when the phaser is in a full retard position.

The piloted valve may be controlled on/off with the same hydraulic circuit that engages or releases one of the two lock pins. This shortens the variable cam timing (VCT) control valve to two hydraulic circuits, a VCT control circuit and a combined lock pin/hydraulic detent control circuit. Movement of the piloted valve to the first position is actively controlled by the remote on/off valve or the control valve of the phaser.

The other of the two lock pins is controlled by the advance or retard working chambers of the phaser.

One of the advantages to using the remote piloted valve is that it can have a longer stroke than the control valve, since it is not limited by a solenoid. Therefore, the piloted valve can open up a larger flow passage for the hydraulic detent mode and improve actuation rate in the detent mode. In addition, the location of the remote piloted valve shortens and simplifies the hydraulic detent circuit and thereby increases performance of the VCT detent mode or intermediate phase angle position of the phaser.

FIGS. 1-9 show the operating modes of a VCT phaser depending on the spool valve position. The positions shown in the figures define the direction the VCT phaser is moving to. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

Referring to FIG. 1-9, in this embodiment, the TA or OPA VCT phasers can have one or more working chambers which operate in a cam torque actuated (CTA) operating mode. The invention utilizes the control valve in a detent mode and a hydraulic detent circuit to direct the VCT phaser in either direction, advance or retard, to reach the mid-lock position and, if so desired, to engage a lock pin at that mid-lock position. The following description and embodiments are described in terms of a torsion assisted (TA) phaser, which has one or more check valves in oil supply lines, but it will be understood that they are also applicable to an oil pressure actuated phaser. An offset or remote piloted valve is added to a hydraulic circuit of a torsion assist or oil pressure actuated phaser to manage the hydraulic detent switching function. One end of the remote piloted valve serves as the first lock pin and in a locked position, locks the housing assembly relative to the rotor assembly at mid-position.

The housing assembly 100 of the phaser has an outer circumference 101 for accepting drive force. The rotor assembly 105 is connected to the camshaft and is coaxially located within the housing assembly 100. The rotor assembly 105 has a vane 104 separating a chamber 117 formed between the housing assembly 100 and the rotor assembly 105 into an advance working chamber 102 and a retard working chamber 103. The vane 104 is capable of rotation to shift the relative angular position of the housing assembly 100 and the rotor assembly 105. Additionally, a hydraulic detent circuit 133 and a lock pin circuit 123 are also present. The hydraulic detent circuit 133 and the lock pin circuit 123 are essentially one circuit as discussed above, but will be discussed separately for simplicity.

The hydraulic detent circuit 133 includes a spring 131 loaded piloted valve 130 and an advance detent line 128 that connects the advance working chamber 102 to the piloted valve 130 and the common line 234 to check valves 108, 110, and a retard detent line 134 that connects the retard working chamber 103 to the piloted valve 130 and the common line 234 to check valves 108, 110. The advance detent line 128 and the retard detent line 134 are a predetermined distance or length from the vane 104. The piloted valve 130 is in the rotor assembly 105 and is fluidly connected to the lock pin circuit 123 and line 142 through line 132. The lock pin circuit 123 includes the piloted valve 130, supply line 142, exhaust at the end of the spool, and line 132. The piloted valve 130 has a first land 130*a* and a second land 130*b* separated by a spindle 130*c*. The second land 130*b* acts as the first lock pin 166. An end portion of the land 130*b* of the piloted valve is biased by spring 131 towards and fits into a recess 170 in the outer end plate 171 of the housing assembly 100. It should be noted that the recess can also be present on the inner end plate of the housing assembly 100.

The second lock pin 167 is slidably housed in a bore 172 in the rotor assembly 105. An end portion 167*a* of the second lock pin 167 fits into a recess 163 in the outer end plate 171 of the housing assembly 100. The second lock pin 167 is pressurized by the retard working chamber 103 through the retard lock port 179 to move towards the locked position, engaging the recess 163. The retard lock port 179 is a predetermined distance or length from the vane 104 and is present in the rotor assembly 105. The retard lock port 179, while drawn schematically in the drawings, is positioned such that the port only receives fluid or is in fluid communication with the retard working chamber 103 when the phaser is in or near the full retard position as discussed further below. The term "near" being defined as the vane being in the retard position or the advance position but the vane not touching the retard working chamber wall or the advance working chamber wall. The retard lock port 179 is not in fluid communication with the retard working chamber 103 when the phaser is moving towards or in the advance position. The second lock pin 167 is spring 144 biased to move to the unlocked position, where the lock pin 167 does not engage the recess 163 of the housing assembly 100 and the retard lock port 179 is vented.

The opening and closing of the hydraulic detent circuit 133 and pressurization of the lock pin circuit 123 are both controlled by the switching/movement of the phase control valve 160.

A control valve 160, preferably a spool valve, includes a spool 111 with cylindrical lands 111*a*, 111*b*, 111*c*, 111*d*, 111*e* slidably received in a sleeve 114. The control valve 160 may be located remotely from the phaser, within a bore in the rotor assembly 105 which pilots in the camshaft, or in a center bolt of the phaser or other housing. As shown, the sleeve 114 is received within a bore 215 of a housing 216 which may be received in the camshaft (not shown).

One end of the spool 111 contains spring 115 and the opposite end of the spool contacts a pulse width modulated variable force solenoid (VFS) (not shown). The solenoid may also be linearly controlled by varying current or voltage or other methods as applicable. Additionally, the opposite end of the spool 111 may contact and be influenced by a motor, or other actuators. The solenoid may be controlled by an engine control unit (ECU) which controls the duty cycle of the variable force solenoid. The ECU preferably includes a central processing unit (CPU) which runs various computational processes for controlling the engine, memory, and input and output ports used to exchange data with external devices and sensors.

The housing 216 has a plurality of ports 120, 121, 122, 124 and opening 214. Port 120 is in fluid communication with an advance line 112 and port 121 is in fluid communication with a retard line 113. Port 122 is in fluid communication with a first lock pin 166 via line 132. Port 124 is fluid communication with a supply via line 142. Opening 214 is for exhausting fluid from line 132 and venting the backside of the spool 111.

The sleeve 114 has a plurality of ports 150, 151, 152, 153, 154, 155, 158; a first recess 157 which connects ports 152 and 153 and a second recess 156 which connects ports 154 and 155. The recess 157 forms a passage for fluid to flow from supply line 142, through the spool 111 via an inlet central passage 181 of the spool 111 to line 132 leading to the lock pin 133. The recess 156 forms a passage for fluid to flow from retard working chamber 103 to the advance working chamber 102 during certain phaser and control valve positions and also vents the retard working chamber to atmosphere via vent 201.

The spool 111 has a central passage which is divided into a working central passage 180 and an inlet central passage 181 by a recirculation check valve 202 and an inlet check valve 203. The recirculation check valve 202 includes a plate 185, a spring 186, a valve seat 210, and spring retaining member 182, with the first end of the spring 186 contacting the plate 185 and the second end of the spring 186 contacting the spring retaining member 182. The inlet check valve 203 includes a valve seat 210, a ball 183, a spring 184, and the spring retaining member 182, with the first end of the spring 184 contacting the spring retaining member 182 and the second end of the spring 184 contacting the ball 183.

Between the first land 111*a* and the second land 111*b* is an opening 189 leading to the working central passage 180. Between the second land 111*b* and the third land 111*c* is an opening 190 leading to the recirculation check valve 202. Between the third land 111*c* and the fourth land 111*d* is an annular groove 217. Between the fourth land 111*d* and the fifth land 111*e* is another annular groove 218 and an opening 191 leading to inlet central passage 181.

Hydraulic lines 112, 113 connect the control valve 160 to the advance working chamber 102 and the retard working chamber 103.

The position of the spool 111 is influenced by spring 115 and the solenoid controlled by the EEC or ECU. Further detail regarding control of the phaser is discussed in detail below. The position of the spool 111 controls the motion (e.g. to move towards the advance position, holding position, the retard position, or the retard lock position) of the phaser as well as whether the lock pin circuit 123 and the hydraulic detent circuit 133 are open (on) or closed (off). In other words, the position of the spool 111 actively controls the piloted valve. The control valve 160 has an advance mode, a retard mode with and without retard locking, a null mode (holding position), and a detent mode.

In the advance mode, the spool 111 is moved to a position so that fluid may flow from supply S via line 142, through the inlet check valve 203 to the advance working chamber 102 and fluid from the retard working chamber 103 exits through the spool 111 and recirculates to the advance working chamber 102 and/or vents through set screw 200. The detent valve circuit 133 is off or closed and the first lock pin 166 is moved to the unlock position by oil pressure from supply line 142 via line 132 and the second lock pin 167 is vented through the retard lock pin port 179 to an unlocked position in which neither lock pin 167, 166 engages a recess 163, 170 of the housing assembly 100.

In the retard mode, the spool 111 is moved to a position so that fluid may flow from supply through line 142 and inlet check valve 203, to the retard working chamber 103 and fluid from the advance working chamber 102 recirculates to the retard working chamber 103 via the recirculation check valve 202 and/or vents through set screw 200. It should be noted that the some of the fluid from the advance working chamber 102 is vented from the spool 111 via an orifice 201 of a set screw 200. The detent valve circuit 133 is off and the first lock pin 166 is biased by pressure from supply line 142 via line 132 and the second lock pin 167 is biased by spring 144 to an unlocked position in which neither the first or second lock pins 167, 166 engage a recess 163, 170 of the housing assembly 100.

In holding position or null mode, the spool 111 is moved to a position that is partially open to the advance working chamber 102 and the retard working chamber 103 and allows supply fluid to bleed into the advance and retard working chambers 102, 103 through the inlet check valve 203, applying the same pressure to the advance working chamber 102 and retard working chamber 103 to hold the vane 104 position. The detent valve circuit 133 is off and the first lock pin 166 is biased by supply pressure from supply line 142 via line 132 to an unlocked position and the second lock pin 167 is biased by spring 144 to an unlocked position in which neither the first or second lock pins 167, 166 engage a recess 163, 170 of the housing assembly 100.

In the retard locking mode, the vane 104 has already been moved to a position in or near a full retard position and fluid continues to flow from supply through inlet check valve 203, to the retard working chamber 103 and fluid from the advance working chamber 102 exits through the spool 111 to recirculate back to the retard working chamber 103 through the recirculation check valve 202. It should be noted that the some of the fluid from the advance working chamber 102 is vented from the spool 111 via an orifice 201 of a set screw 200. Fluid from the retard working chamber 103 provides pressure to the second lock pin 167 through the retard locking port 179 to engage recess 163, as the retard locking port 179 in this position is in fluid communication with the retard working chamber 103. The second lock pin 167 is pressurized to engage only when the vane 104 of the rotor assembly 105 is at or near the retard stop. The retard locking port 179 can be radial or axial and is metered by the housing assembly 100 or a feature in the end plate 171. Any duty cycle of the VFS above the null position pressurizes the retard working chamber 103. The "full retard position" is defined as the vane 104 contacting the advance wall 102*a* of the chamber 117. The first lock pin 166 is moved to the unlock position by oil pressure from supply line 142 via line 132 to an unlocked position.

In the detent mode, three functions occur simultaneously. The first function in the detent mode is that the spool 111 moves to a position in which spool land 111*e* blocks fluid from flowing to line 132 of the piloted valve 130, and spool lands 111*c* and 111*d* block fluid from exiting from line 113 connected to the retard working chamber 103. Fluid from line 142 can enter the advance working chamber 102, through the inlet check valve 203 and line 112. Fluid will also fill the retard working chamber 103 through the detent valve circuit 133 due to a slight underlap of the ports of the lines 128 and 134 of the piloted valve 130 and the rotor assembly 105. By blocking the retard line 113 by the spool 111 to keep the advance and retard working chambers 102, 103 full, effectively removes control of the phaser from the control valve 160.

The second function in detent mode is to open or turn on the detent valve circuit 133. With the detent valve is open, one or more of the torsion assist advance and retard working chambers 102, 103 are converted to cam torque actuated (CTA) mode. In other words, fluid is allowed to recirculate between the advance working chamber 102 and the retard working chamber 103, instead of supply filling one chamber and exhausting some of the fluid. The detent valve circuit 133 has complete control over the phaser moving to advance or retard, until the vane 104 reaches the intermediate phase angle position. The piloted valve 130 is moved to this position through the blocking of fluid to line 132, such that the spring 131 moves the piloted valve 130 and the first lock pin 166 to engage the recess 170 of the outer end plate 171.

The third function in the detent mode is to vent the lock pin circuit 123, allowing the first lock pin 166 to engage the recess 170 of the housing assembly 100. The intermediate phase angle position or mid-position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the detent passages 128 and 134 are relative to the vane 104.

Based on the duty cycle of the pulse width modulated variable force solenoid, the spool 111 moves to a corresponding position along its stroke. When the duty cycle of the variable force solenoid is approximately 40%, 60%, or greater than 60%, the spool 111 will be moved to positions that correspond with the advance mode, the holding position, and the retard/retard locking mode, respectively and the piloted valve 130 will be pressurized and move to the second position, the hydraulic detent circuit 133 will be closed, and the first lock pin 166 will be pressurized and released. In the retard locking mode, the second lock pin 167 is pressurized to engage when the retard working chamber 103 is in the full retard position and the retard locking port 179 is in fluid communication with the retard working chamber 103, the advance working chamber 102 vented and the second lock pin 167 engages the recess 163 of the outer end plate 171 of the housing assembly 100. It should be noted that in an alternate embodiment, the second lock pin 167 can be supplied with fluid by an advance locking port in fluid communication with the advance working chamber when the phaser is in a full advance position, and the retard working chamber 103 is vented, which then allows the second lock pin 167 to be pressurized to engage the recess and move to a locked position.

When the duty cycle of the variable force solenoid is 0%, the spool 111 is moved to the detent mode such that the piloted valve 130 vents and moves to the second position, the hydraulic detent circuit 133 will be open, and the first lock pin 166 vented and engaged with the recess 170. A duty cycle of 0% was chosen as the extreme position along the spool stroke to open the hydraulic detent circuit 133, vent the piloted valve 130, and vent and engage the first lock pin 166 with the recess 170, since if power or control is lost, the phaser will default to a locked position. It should be noted that the duty cycle percentages listed above are an example and they may be altered. Furthermore, the hydraulic detent circuit 133 may be open, the piloted valve 130 vented, and the first lock pin 166 vented and engaged with the recess 170 at 100% duty cycle, if desired.

It should be noted that the duty cycle of the variable force solenoid of approximately 40%, 60%, or greater than 60% may alternatively correspond to the spool 111 being moved to positions that correspond to the retard mode, the holding position, and the advance mode/advance locking mode, respectively.

When the duty cycle is set to be greater than 60%, the vane of the phaser is moving toward and/or in a retard position. The stroke of the spool or position of the spool relative to the sleeve is between 3.5 and 5 mm for the retard position.

Figure 5:
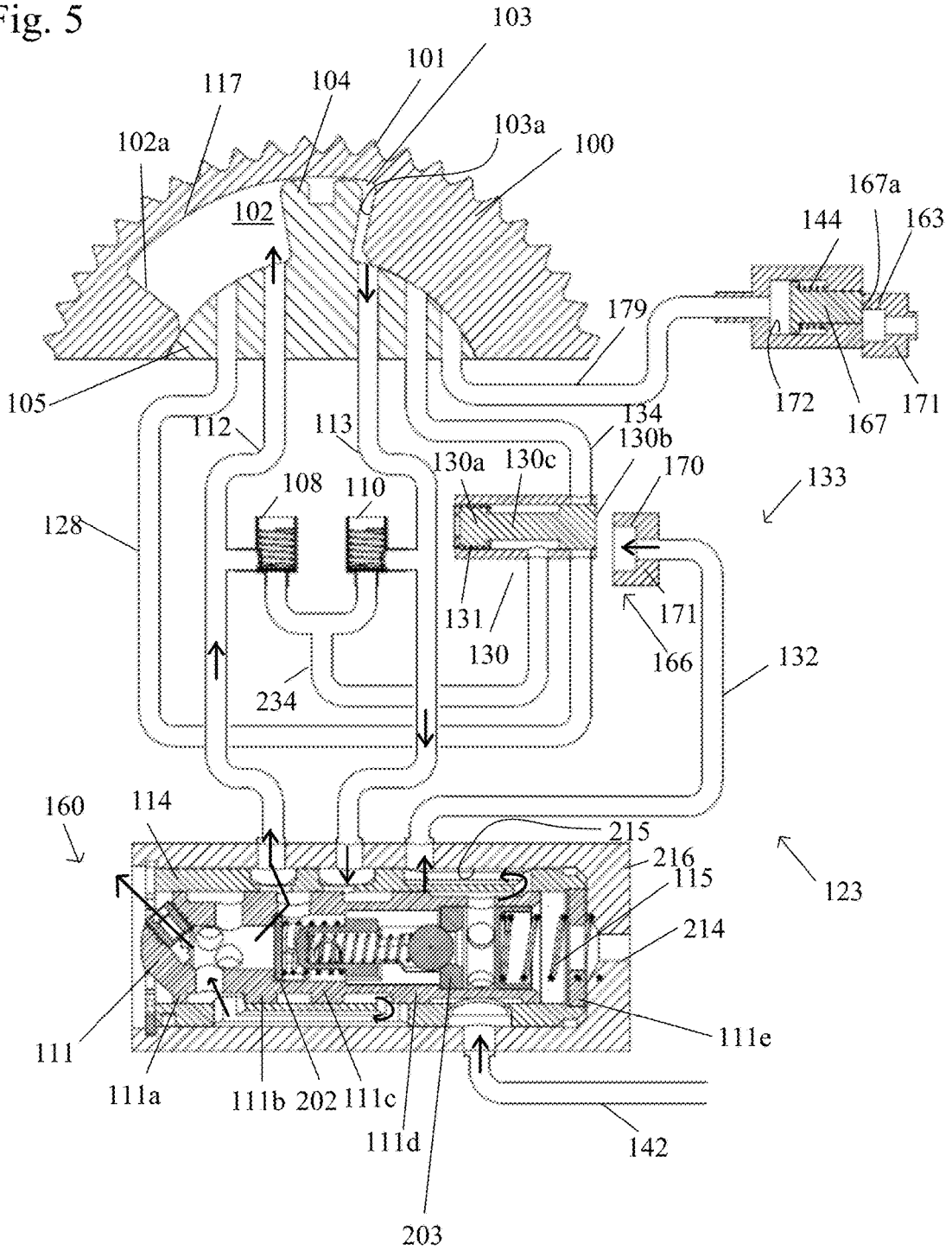
FIG. 5 shows a schematic of a variable cam timing phaser operating in a fifth state or mode or moving towards the advance position.
Figure 9:
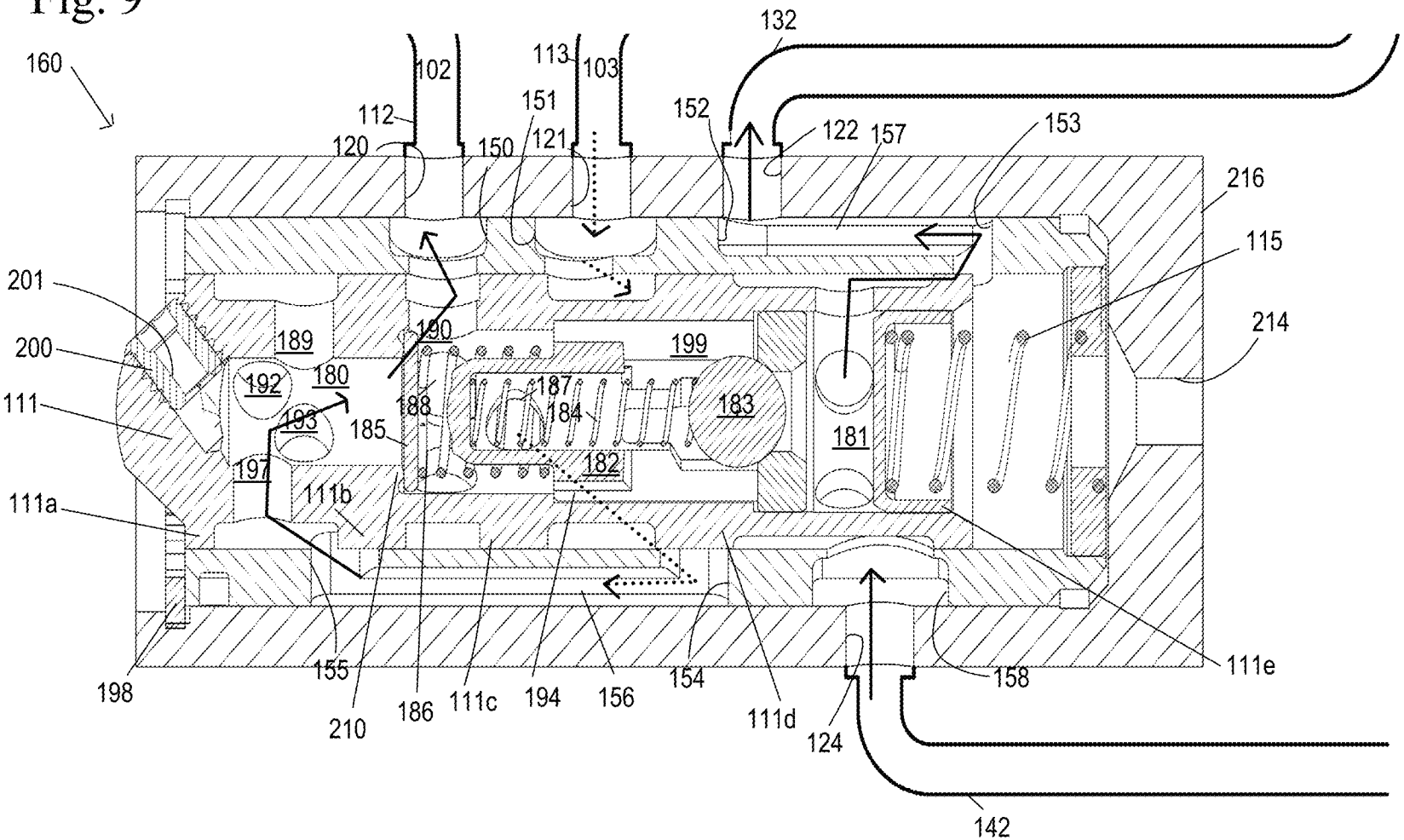
FIG. 9 shows a close-up of the control valve of the phaser operating in an advance mode.

FIG. 5 shows the phaser moving towards the advance position and FIG. 9 shows a close-up of fluid flow through the control valve of the phaser in the advance mode. To move towards the advance position, the duty cycle is 40% but not greater than 60%, the force of the VFS on the spool 111 is decreased and the spool 111 is moved to the left by the spring 115 in an advance mode, until the force of the spring 115 balances the force of the VFS.

In the advance mode shown, hydraulic fluid enters the control valve 160 via line 142. From line 142, fluid flows through port 158, through hole 206 and into the inlet central passage 181. The fluid flows from the inlet central passage 181 through opening 191, between spool lands 111*d* and 111*e* to passage 157. From passage 157, fluid flows through port 122 to line 132. Fluid in line 132 biases the first lock pin 166 against the spring 131 to a released position, filling the lock pin circuit 123 with fluid. The fluid in line 132 also pressurizes the piloted valve 130 against the spring 131, moving the piloted valve 130 to a position where retard detent line 134, advance detent line 128 and line 114 are blocked and the detent circuit is off. The end of the spool 111 is blocked by spool land 161*e*, preventing the first lock pin 166 and piloted valve 130 from venting out the end of the spool 111 via opening 214.

Fluid from the inlet central passage 181 also flows through the inlet check valve 203. The pressure of the fluid in the inlet central passage 181 move the ball 183 against the force of the spring 184, lifting the ball 183 off of the valve seat 210, such that fluid can flow into passage 199 formed between the spring retaining member 182 and the inner diameter 195 of the spool 111 or hole 187 within the spring retaining member 182 in fluid communication with opening 190, leading to the advance working chamber 102 through line 112. Therefore, line 112 is open to fluid from supply.

Fluid from the retard working chamber 103 is exhausted through line 113 and through port 121 and port 151 in the sleeve 114 the outer diameter of the spool 111 between spool lands 111*c* and 111*d*. From the outer diameter of the spool 111, fluid flows to passage 156 of the sleeve 114 and enters opening 197 between spool lands 111*a* and 111*b* to the working central passage 180. From the working central passage 180, the pressure of the fluid biases the disk or plate 185 against the spring 184, such that the plate 185 lifts off and away from the valve seat 210. Fluid flows from the working central passage 180, through the recirculation check valve 202, through openings 190 and 150, through port 120 and to line 112 in fluid communication with the advance working chamber 102. Fluid in line 112 moves into the advance working chamber 102 and moves the vane 104 towards the retard wall 103*a*, and causing fluid to exit from the retard working chamber 103 and into line 113 to the control valve 160. Due to the position of the retard lock port 179 relative to the retard working chamber 103 (blocked), spring 144 biases the lock pin 167 to an unlocked position.

Figure 3:
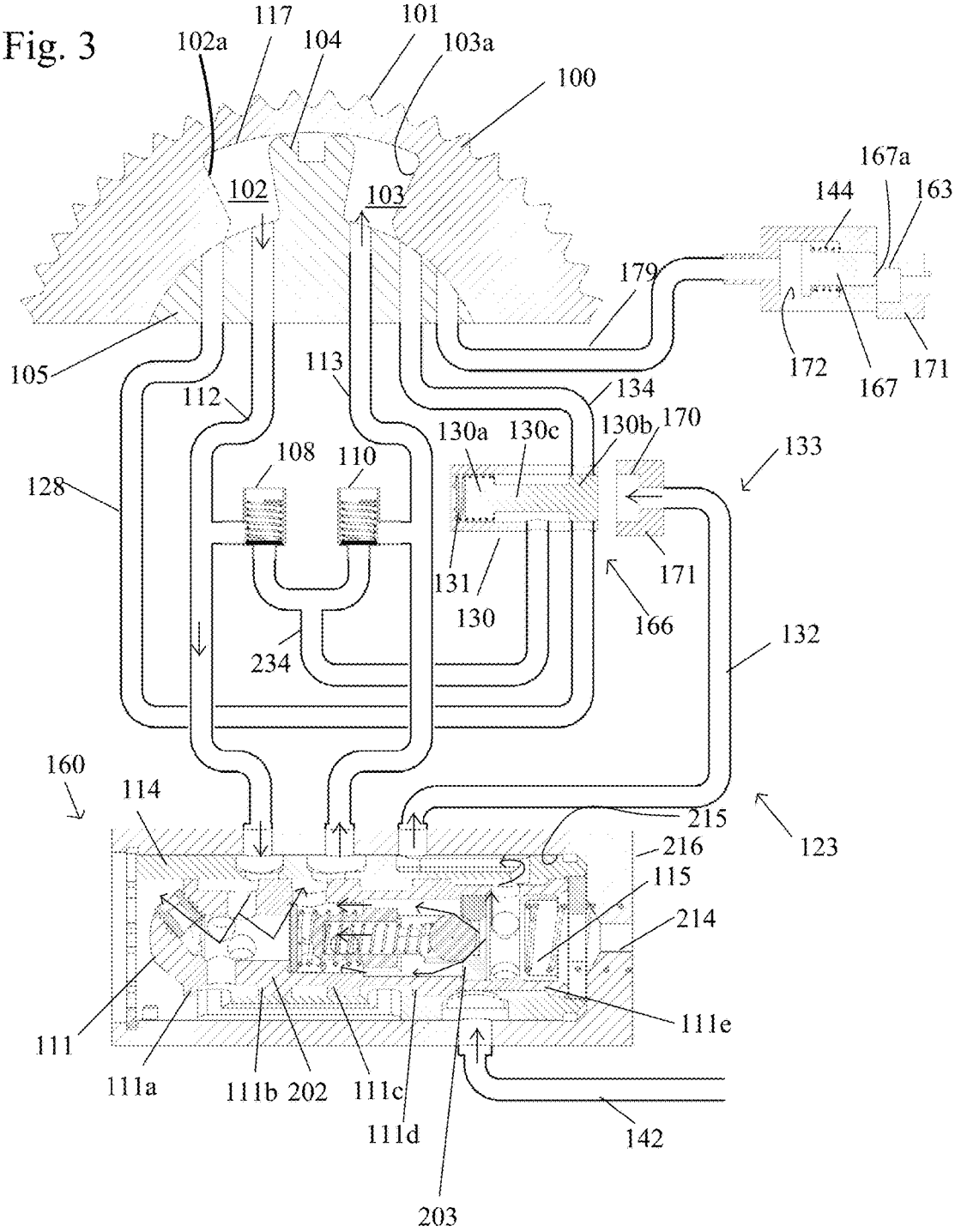
FIG. 3 shows a schematic of a variable cam timing phaser operating in a third state or mode in which lock pins are releasing and the phaser is moving towards the retard position.
Figure 7:
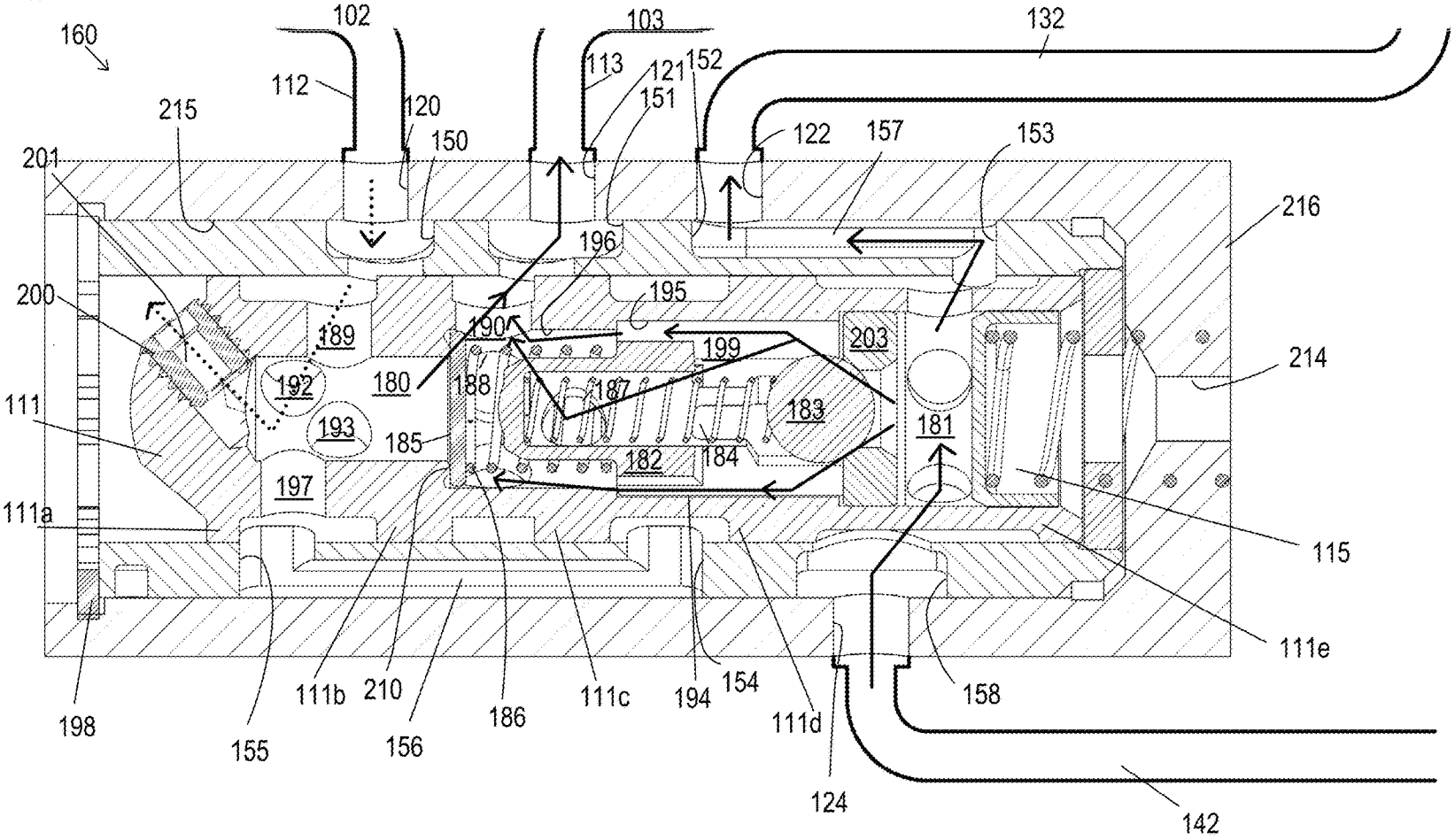
FIG. 7 shows close-up of the control valve of the phaser operating in the retard mode.

FIG. 3 shows the phaser moving towards the retard position and FIG. 7 shows a close-up of fluid flow through the control valve of the phaser in the retard mode. To move towards the retard position, the duty cycle is adjusted to a range greater than 60%, the force of the VFS on the spool 111 is changed and the spool 111 is moved to the right in a retard mode in the figure by VFS, until the force of spring 115 balances the force of the VFS.

In the retard mode shown, hydraulic fluid enters the control valve 160 via line 142. From line 142, fluid flows through port 158, through hole 206, and into the inlet central passage 181. The fluid flows from the inlet central passage 181 through opening 191, between spool lands 111*d* and 111*e* to passage 157. From passage 157, fluid flows through port 122 to line 132. Fluid in line 132 biases the first lock pin 166 against the spring 131 to a released position, filling the lock pin circuit 123 with fluid. The fluid in line 132 also pressurizes the piloted valve 130 against the spring 131, moving the piloted valve 130 to a position where retard detent line 134, advance detent line 128 and line 114 are blocked and the detent circuit is off. The end of the spool 111 is blocked by spool land 161*e*, preventing the first lock pin 166 and piloted valve 130 from venting out the end of the spool 111.

From the inlet central passage 181 also flows through the inlet check valve 203. The pressure of the fluid in the inlet central passage 181 move the ball 183 against the force of the spring 184, lifting the ball 183 off of the valve seat 210, such that fluid can flow into passage 199 formed between the spring retaining member 182 and the inner diameter 195 of the spool 111 or hole 187 within the spring retaining member 182 in fluid communication with opening 190, leading to the retard working chamber 103 through line 113. Therefore, line 113 is open to fluid from supply.

Fluid from the advance working chamber 102 is exhausted through line 112 to the working central passage 180. Some of the fluid exhausted from the advance working chamber 102 is exhausted from the working central passage 180 through a vent of the set screw 200. In this embodiment, the vent is an orifice 201 of a set screw 200. In a preferred embodiment, 20-30% of the fluid from the advance working chamber 102 and 70-80% of the fluid is recirculated to the retard working chamber 103. The diameter of the orifice 201 may be varied to vary the percentage of fluid that is vented from the working central passage 180 as applicable to the application in which the phaser is being used. From the working central passage 180, the pressure of the fluid biases the disk or plate 185 against the spring 184, such that the plate 185 lifts off and away from the valve seat 210. Fluid flows from the working central passage 180, through the recirculation check valve 202, through openings 190, and 151, through port 121 and to line 113 in fluid communication with the retard working chamber 103. Fluid in line 113 moves into the retard working chamber 103 and moves the vane 104 towards the advance wall 102*a*, and causing fluid to exit from the advance working chamber 102 and into line 112 to the control valve 160.

Due to the position of the retard lock port 179 relative to the retard working chamber 103 (blocked), spring 144 biases the lock pin 167 to an unlocked position.

The pressure of the fluid in line 142 also moves through the spool 111 between lands 111*d* and 111*e* to line 132, to bias the first lock pin 166 against the spring 131 to a released position, filling the lock pin circuit 123 with fluid. The fluid in line 132 also pressurizes the piloted valve 130 against the spring 131, moving the piloted valve 130 to a position where retard detent line 134, advance detent line 128 and line 114 are blocked and the detent circuit is off. The end of the spool 111 is blocked by spool land 111*e*, preventing the first lock pin 166 and piloted valve 130 from venting out the end of the spool 111.

Figure 2:
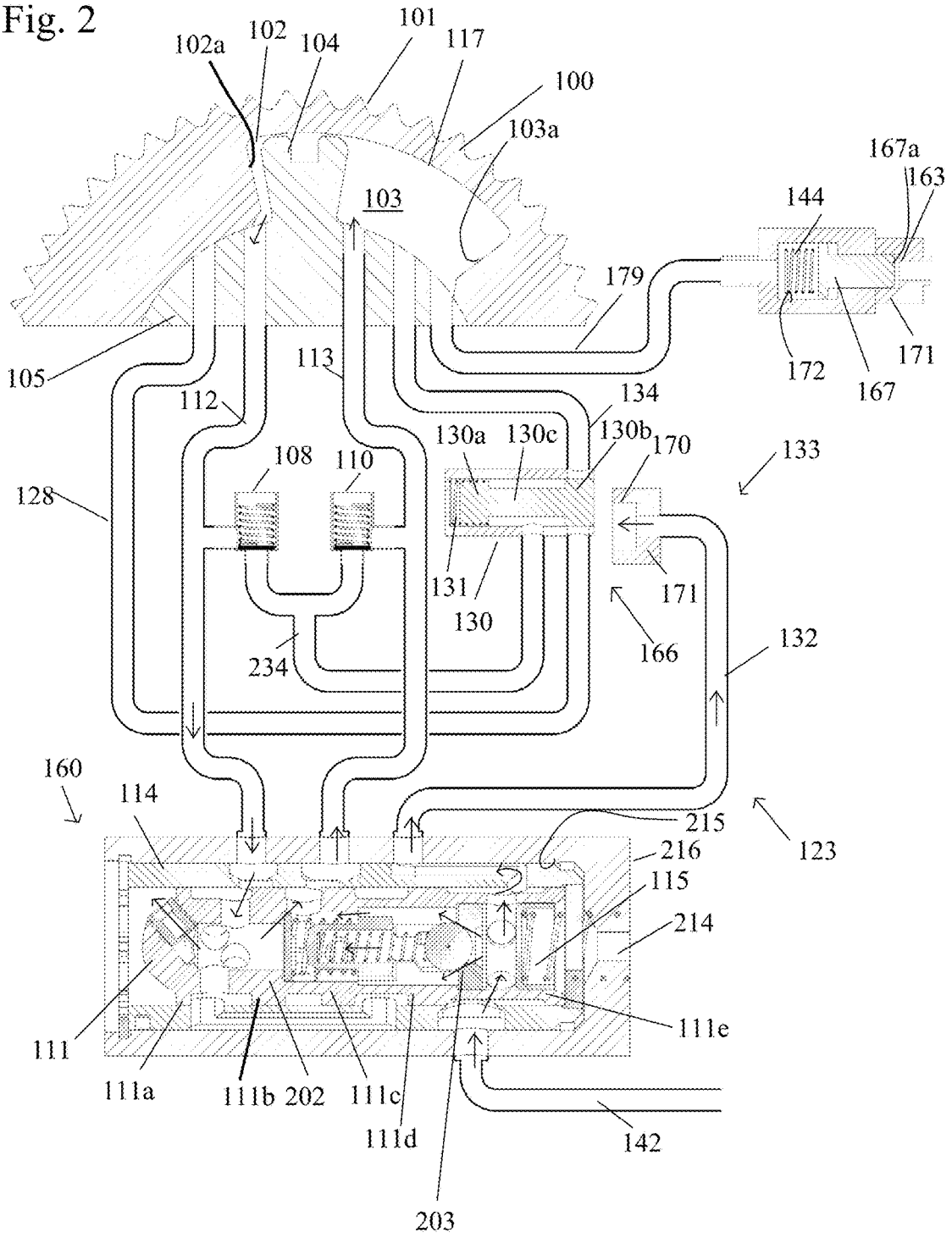
FIG. 2 shows a schematic of a variable cam timing phaser operating in a second state or mode of full retard position with lock pin engagement.

Due to the position of the retard lock port 179, fluid is not provided to line 179 until the vane 104 is approximately adjacent to the advance wall 102*a*. Prior to the vane 104 being adjacent to the advance wall 102*a*, the spring 144 of the second lock pin 167 biases the lock pin to an unlocked position. Once the vane is at or near the "full retard stop"

discussed in further detail below and the retard lock port 179 becomes exposed to fluid present in the retard working chamber 103, fluid from the retard lock port 179 biases the second lock pin 167 to attempt to engage the recess 163 of the outer end plate 171 when the recess 163 aligns with the second lock pin 167 as shown in FIG. 2, the housing assembly 100 is locked relative to the rotor assembly 105.

When the duty cycle is set greater than 60%, the vane 104 of the phaser is moving toward and/or in a retard locking position. The stroke of the spool or position of the spool relative to the sleeve is approximately 3.5-5.0 mm for the retard locking position.

FIG. 2 shows the phaser in the retard locking position at the full retard position and FIG. 7 shows a close up of the control valve in the retard mode. To move towards the retard position, the duty cycle is adjusted to a range greater than 60%, the force of the VFS on the spool 111 is changed and the spool 111 is moved to the right in a retard mode in the figure by VFS, until the force of spring 115 balances the force of the VFS. In the retard locking mode shown, fluid from supply via line 142 enters the inlet central passage 181. From the inlet central passage, fluid flows through the inlet check valve 203, through opening 190 and into port 151 of the sleeve 114 and to port 121 leading to line 113. From line 113 fluid enters the retard working chamber 103 moving the vane 104 towards the advance wall 102*a*, and causing fluid to move from the advance working chamber 102 to exit into line 112 to the control valve 160, with some of the fluid being exhausted by venting through the orifice 201 of the set screw 200. Fluid flows to the retard working chamber 103 through the recirculation check valve 202. The phaser is in a full retard position when the vane 104 contacts or nearly contacts the advance wall 102*a*.

The pressure of the fluid in line 142 also moves through the spool 111 between lands 111*d* and 111*e* to line 132, to bias the first lock pin 166 against the spring 131 to a released position, filling the lock pin circuit 123 with fluid. The fluid in line 132 also pressurizes the piloted valve 130 against the spring 131, moving the piloted valve 130 to a position where retard detent line 134, advance detent line 128 and line 114 are blocked and the detent circuit is off. The end of the spool 111 is blocked by spool land 111*e*, preventing the first lock pin 166 and piloted valve 130 from venting out the opening 214 of the spool 111.

Once the vane is at or near the "full retard stop" the retard lock port 179 becomes exposed to fluid present in the retard working chamber 103, and fluid from the retard lock port 179 biases the second lock pin 167 to engage the recess 163 of the outer end plate 171 when the recess 163 aligns with the second lock pin 167, locking the housing assembly 100 relative to the rotor assembly 105.

The holding position of the phaser preferably takes place between the retard and advance position of the vane relative to the housing. The stroke of the spool or position of the spool relative to the sleeve is approximately 3.5 mm.

Figure 6:
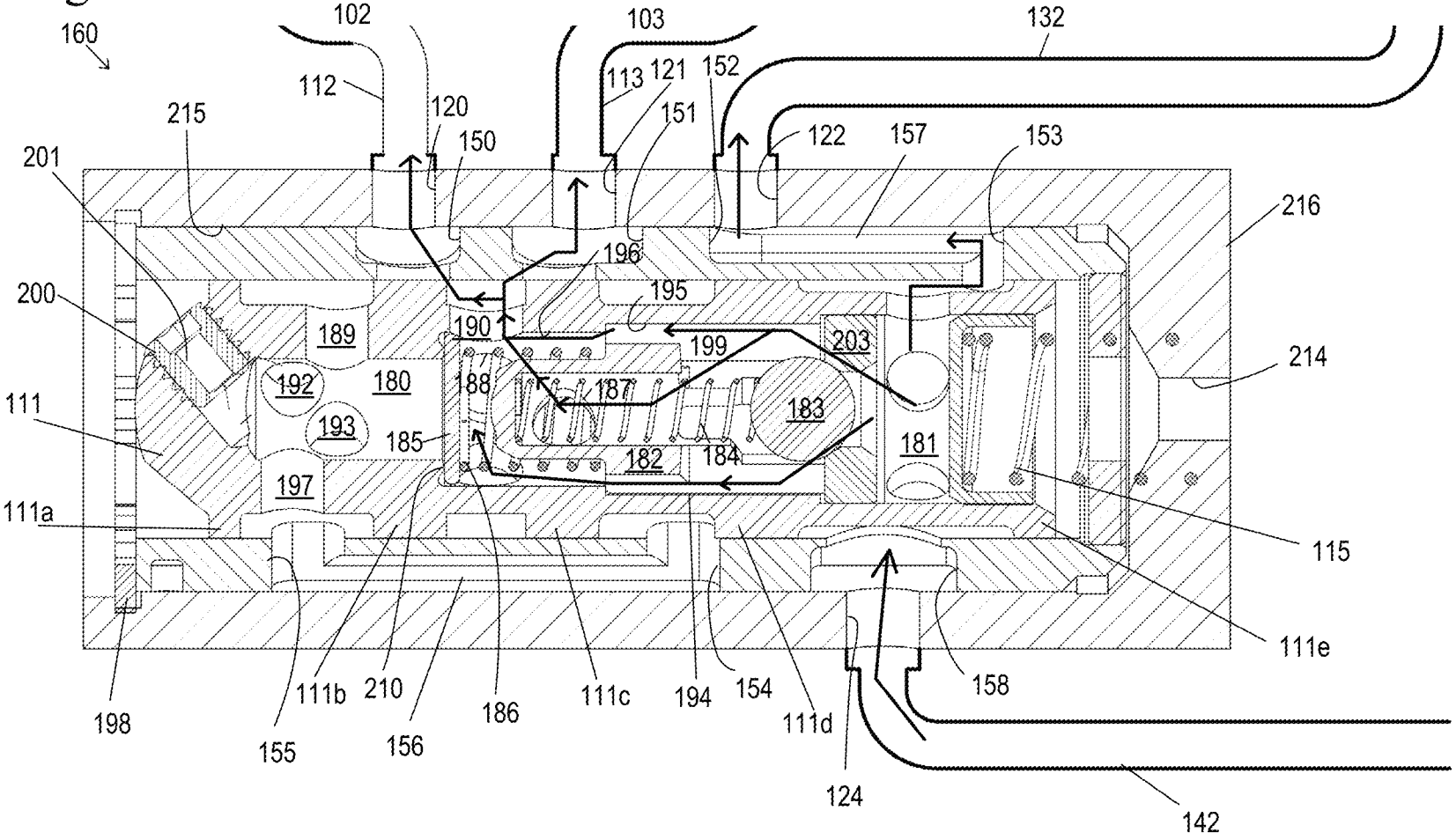
FIG. 6 shows a close-up of the control valve of the phaser operating in the holding mode.

FIG. 1 shows the phaser in the holding position and FIG. 6 shows the control valve of the phaser operating in the holding mode. In this position, the duty cycle of the variable force solenoid is approximately 60% and the force of the VFS on one end of the spool 111 equals the force of the spring 115 on the opposite end of the spool 111 in holding mode. The lands 161*b* and 161*c* allow fluid from supply S to bleed into the advance working chamber 102 and the retard working chamber 103.

Line 142 provides fluid from supply, which enters the control valve 160, flows into the inlet central passage 181 and then flows through the inlet check valve 203. After passing through the inlet check valve 203, fluid flows to opening 190 either via hole 187 or passage 199 and enters lines 112 and 113 and the advance working chamber 102 and the retard working chamber 103 via undercuts of the spool lands 111*b* and 111*c*.

The pressure of the fluid in line 142 also moves into the inlet central passage 181 and passes to line 132 between lands 111*d* and 111*e* to bias the first lock pin 166 against the spring 131 to a released position, filling the lock pin circuit 123 with fluid. The fluid in line 132 also pressurizes the piloted valve 130 against the spring 131, moving the piloted valve 130 to a position where retard detent line 134, advance detent line 128 and common line 234 are blocked and the detent circuit is off. Fluid is prevented from exhausting through the orifice 201 of the set screw by spool lands 111*b* and 111*c*. Spool land 111*e* prevents the first lock pin 166 and piloted valve 130 from venting out through opening 214 of the end of the spool 111.

Due to the position of the retard lock port 179 relative to the retard working chamber 103 (e.g. the retard locking port 179 is not accessible to the retard working chamber 103), spring 144 of the second lock pin 167 biases the lock pin to an unlocked position.

When the duty cycle is 0%, the vane of the phaser is in the mid-position or intermediate phase angle position. The stroke of the spool or position of the spool relative to the sleeve is 0 mm.

Figure 4:
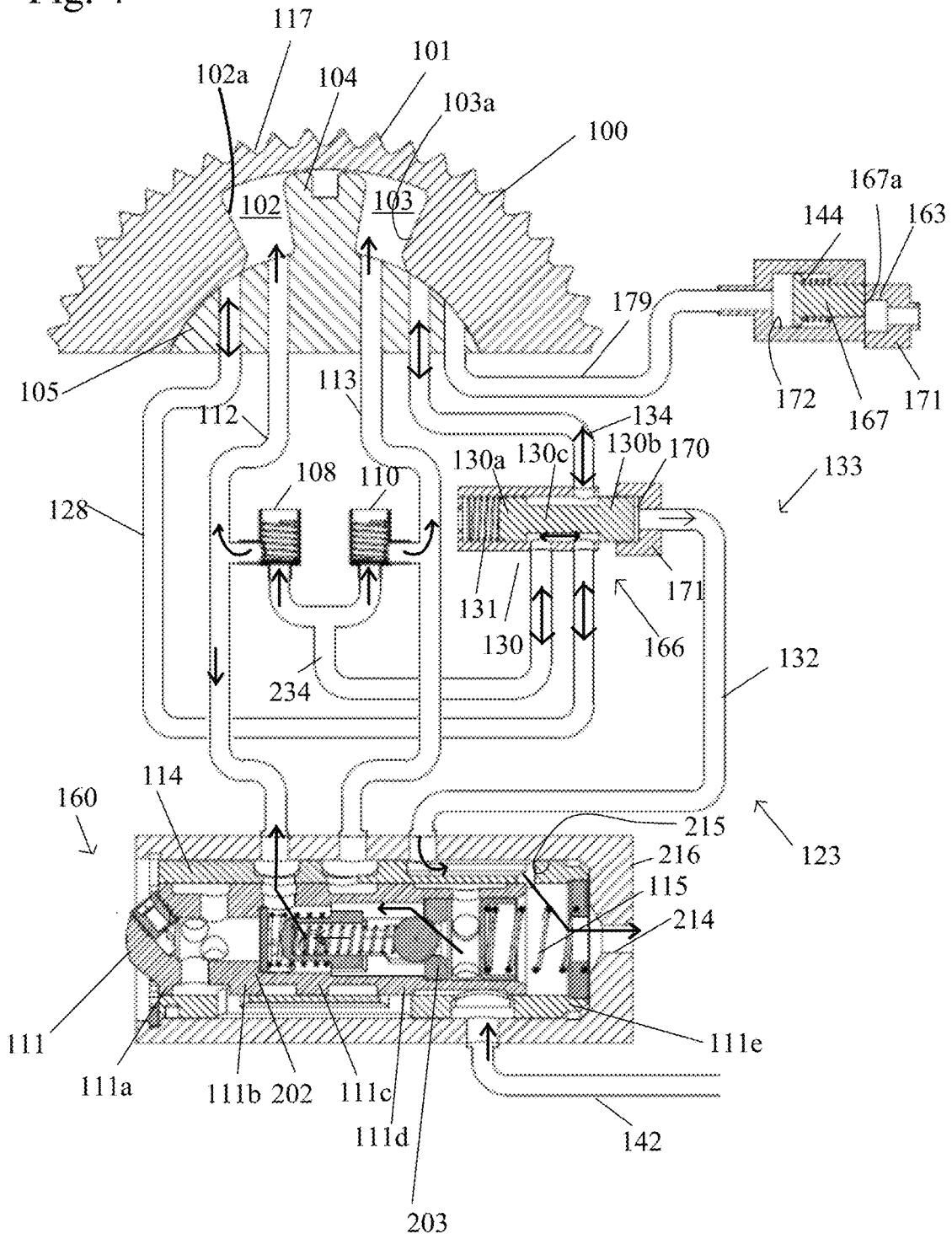
FIG. 4 shows a schematic of a variable cam timing phaser operating in a fourth state or mode or in a midlock or intermediate position.
Figure 8:
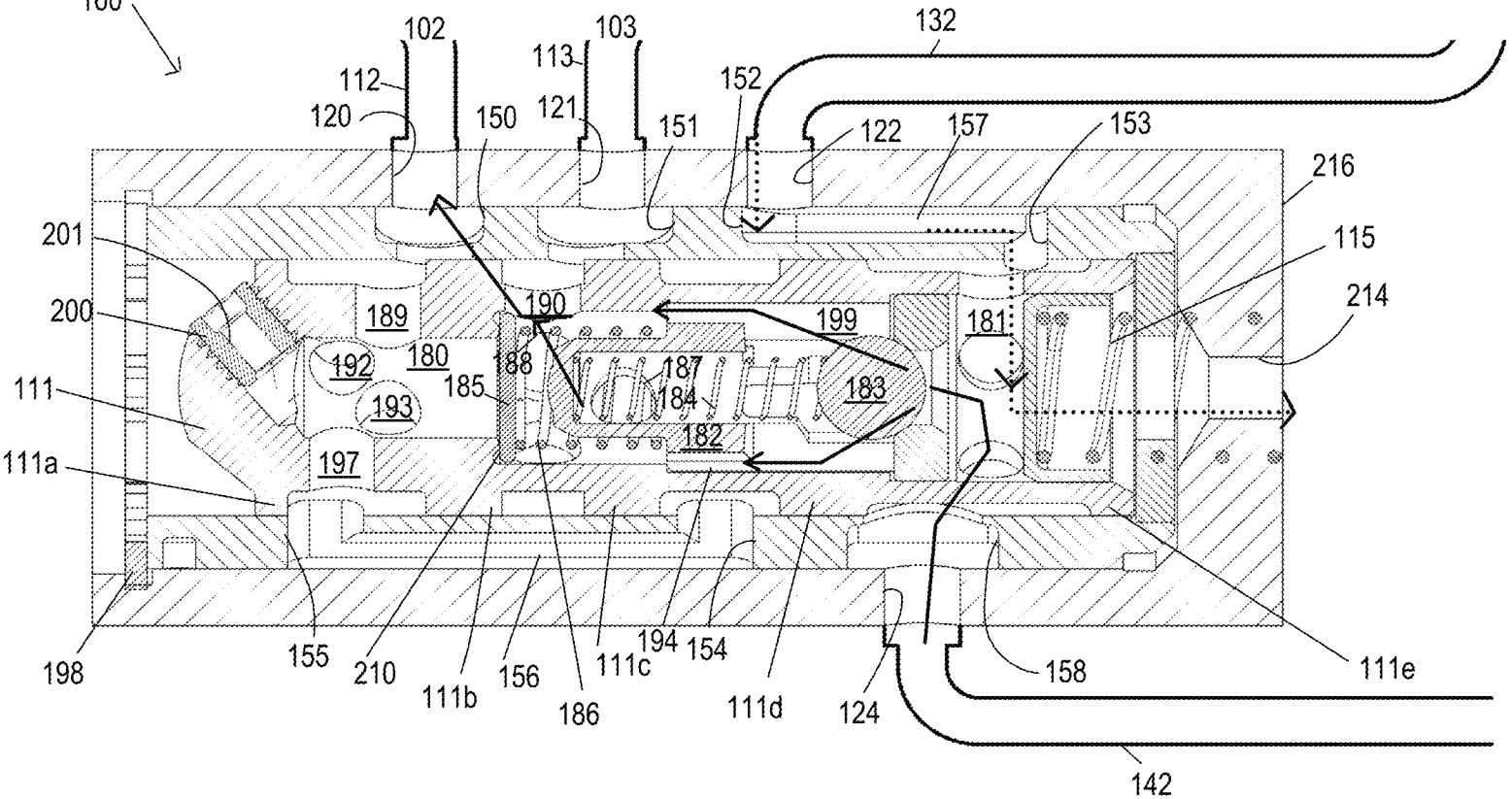
FIG. 8 shows a close-up of the control valve of the phaser operating in the intermediate phase angle mode.

FIG. 4 shows the phaser in the mid-position or intermediate phase angle position, and FIG. 8 shows a close-up of the control valve in the intermediate phase angle mode, where the duty cycle of the variable force solenoid is 0%, the spool 160 is in detent mode, the piloted valve 130 is vented through the end of the spool 111 leading to sump or exhaust, and the hydraulic detent circuit 133 is open or on and the first lock pin 166 is vented and engages with a recess 170, and the rotor assembly 105 is locked relative to the housing assembly 100 in a mid-position or an intermediate phase angle position. Depending on where the vane 104 was prior to the duty cycle of the variable force solenoid being changed to 0%, either the advance detent line 128 or the retard detent line 134 will be exposed to the advance or retard working chamber 102, 103 respectively. In addition, if the engine had an abnormal shut down (e.g. the engine stalled), when the engine is cranking, the duty cycle of the variable force solenoid would be 0%, the rotor assembly 105 would move via the detent circuit 133 to a mid-lock position or an intermediate phase angle position and the first lock pin 166 would be engaged in mid-position or intermediate phase angle position regardless of what position the vane 104 was in relative to the housing assembly 100 prior to the abnormal shut down of the engine. In the present invention, detent mode is preferably when the spool 111 is an extreme end of travel. In the examples shown in the present invention, it is when the spool 111 is at an extreme full out position from the bore.

The ability of the phaser of the present invention to detent to a mid-position or intermediate phase angle position without using electronic controls allows the phaser to move to the mid-position or intermediate phase angle position even during engine cranking when electronic controls are not typically used for controlling the cam phaser position. In addition, since the phaser detents to the mid-position or intermediate phase angle position, it provides a fail-safe position, especially if control signals or power is lost, that guarantees that the engine will be able to start and run even without active control over the VCT phaser. Since the phaser has the mid-position or intermediate phase angle position upon cranking of the engine, longer travel of the phase of the phaser is possible, providing calibration opportunities. In the prior art, longer travel phasers or a longer phase angle is not possible, since the mid-position or intermediate phase angle position is not present upon engine cranking and startup and the engine has difficulty starting at either the extreme advance or retard stops.

When the duty cycle of the variable force solenoid is set to 0%, the force on the VFS on the spool 111 is decreased, and the spring 115 moves the spool 111 to the far left end of the spool's travel to a detent position. In this detent position, spool land 111*b* blocks the flow of fluid from line 112 to orifice 201 of the set screw 200 and spool land 111*d* blocks the flow of fluid between the advance working chamber 102 and the retard working chamber 103 from within the control valve 160, effectively removing control of the phaser from the control valve 160. At the same time, fluid from supply may flow through line 142 to the inlet central passage 181 of the control valve 160. From the inlet central passage 181, fluid flows to opening 190 in fluid communication with line 112 either via passage 199 or via hole 187. Fluid from supply is blocked from flowing to line 113 and the retard working chamber 103 via spool land 111*c*. The interface between spool land 111*e* and the sleeve 114 prevents the flow of fluid from the inlet working central passage 180 from passing to line 132 and passage 157. Since fluid cannot flow to line 132, the first lock pin 166 is no longer pressurized and vents through the back end of the spool valve 160 via opening 214 and the piloted valve 130 is also vented, opening passage between the advance detent line 128 and the retard detent line 134 through the piloted valve 130 and the common line 234, in other words opening the hydraulic detent circuit 133 and essentially converting all of the torsion assist chambers into cam torque actuated chambers (CTA) or into CTA mode with circulation of fluid being allowed between the advance working chamber 102 and the retard working chamber 103. Fluid is provided to the retard working chamber 103 via recirculation through the piloted valve 130.

Due to the position of the retard lock port 179 relative to the retard working chamber 103 (e.g. the retard locking port is not accessible to the retard working chamber 103), spring 144 of the second lock pin 167 biases the lock pin to an unlocked position.

If the vane 104 was positioned within the housing assembly 100 near or in the retard position and the retard detent line 134 is exposed to the retard working chamber 103, then fluid from the retard working chamber 103 will flow into the retard detent line 134 and through the open piloted valve 130 leading to common line 234. From the common line 234, fluid flows through check valve 108 and into the advance working chamber 102, moving the vane 104 relative to the housing assembly 100 to close off the retard detent line 134 to the retard working chamber 103. As the rotor 105 closes off line the retard detent 134 from the retard working chamber 103, the vane 104 is moved to an intermediate phase angle position or a mid-position within the chamber formed between the housing assembly 100 and the rotor assembly 105, and the first lock pin 166 aligns with the recess 170, locking the rotor assembly 105 relative to the housing assembly 100 in a mid-position or an intermediate phase angle position. It should be noted that the second lock pin 167 does not engage the recess 163 and remains in an unlocked position.

If the vane 104 was positioned within the housing assembly 100 near or in the advance position and the advance detent line 128 is exposed to the advance working chamber 102, then fluid from the advance working chamber 102 will flow into the advance detent line 128 and through the open piloted valve 130 and to line 114. From the common line 234, fluid flows through check valve 110 and into the retard working chamber 103, moving the vane 104 relative to the housing assembly 100 to close off or block advance detent line 128 to the advance working chamber 102. As the rotor assembly 105 closes off the advance detent line 128 from the advance working chamber 102, the vane 104 is moved to an intermediate phase angle position or a mid-position within the chamber formed between the housing assembly 100 and the rotor assembly 105, and the first lock pin 166 aligns with recess 170, locking the rotor assembly 105 relative to the housing assembly 100 in a mid-position or an intermediate phase angle position. It should be noted that the second lock pin 167 does not engage the recess 163 and remains in an unlocked position.

The advance detent line 128 and the retard detent line 134 are substantially closed off or blocked by the rotor assembly 105 from the advance and retard working chambers 102, 103 when phaser is in the mid-position or intermediate phase angle position, requiring that the first lock pin 166 engages the recess 170 at the precise time in which the advance detent line 128 or the retard detent line 134 are closed off from their respective chambers. Alternatively, the advance detent line 128 and the retard detent line 134 may be slightly open or partially restricted to the advance and retard working chambers 102, 103, in the mid-position or intermediate phase angle position to allow the rotor assembly 105 to oscillate slightly, increasing the likelihood the first lock pin 166 will pass over the position of the recess 170 so the first lock pin 166 can engage the recess 170.

Alternatively, the retard locking mode may be replaced with an advance locking mode. In this mode, the detent valve circuit is off, and the second lock pin 167 is pressurized causing the second lock pin 167 to engage the recess 163 of the outer end plate 171 and move to a locked position. The 'full advance position" is defined as the vane 104 contacting the retard wall 103*a* of the chamber 117. It should be noted that the layout would be a mirror image of that shown in FIGS. 1-10.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system including a phaser for an internal combustion engine including a housing assembly with an outer circumference for accepting drive force and a rotor assembly coaxially located within the housing for connection to a camshaft, having a plurality of vanes, wherein the housing assembly and the rotor assembly define at least one chamber separated by a vane of the plurality of vanes into an advance working chamber with an advance wall and a retard working chamber with a retard wall, the vane of the plurality of vanes within the chamber acting to shift relative angular position of the housing assembly and the rotor assembly when fluid is supplied to the advance working chamber or the retard working chamber, the variable cam timing system further comprising:

a control valve for directing fluid from a fluid input to and from the advance working chamber and the retard working chamber through an advance line, a retard line, a supply line coupled to the fluid input, and a vent;

the control valve being moveable through multiple modes comprising: an advance mode in which fluid is routed from the fluid input to the advance working chamber and fluid is routed from the retard working chamber to a vent and to the advance working chamber through a recirculation check valve, a retard mode in which fluid is routed from the fluid input to the retard working chamber and fluid is routed from the advance working chamber to the vent and to the retard working chamber through the recirculation check valve; a holding position in which fluid is routed to the advance working chamber and the retard working chamber, a first locking mode associated with the locking of a first lock pin and a second locking mode associated with the locking of a second lock pin, wherein during at least one of the first and second locking modes, the vane is adjacent to the advance wall or the retard wall;

the first lock pin slidably located in the rotor assembly, the first lock pin being moveable within the rotor assembly from a locked position in which an end portion of the first lock pin engages a first recess of the housing assembly, to an unlocked position in which the end portion does not engage the first recess of the housing assembly, the first recess in fluid communication with the supply line; and the second lock pin slidably located in the rotor assembly and in communication with either of the advance working chamber or the retard working chamber through a lock port, the second lock pin being moveable within the rotor assembly from a locked position in which an end portion of the second lock pin engages a second recess of the housing assembly through pressure from either the retard working chamber or advance working chamber via the lock port, to an unlocked position in which the end portion is spring biased to not engage the second recess of the housing assembly;

wherein when the control valve is in the second locking mode, fluid from the advance working chamber or the retard working chamber flows through the lock port to move the second lock pin to a locked position, locking the relative angular position of the housing assembly and the rotor assembly and the first lock pin is moved to an unlocked position by pressure supplied from the supply line.

2. The system of claim 1, wherein the control valve further comprises:

a hollow sleeve with a plurality of ports, where at least two of the ports are connected by a recirculation recess; and a spool received within the hollow sleeve comprising:

a plurality of lands for selectively blocking the plurality of ports of the hollow sleeve;

a working central passage located within the spool;

an inlet passage located within the spool;

the recirculation check valve received within the working central passage, limiting the flow of fluid between the first and second chambers through the working central passage; and an inlet check valve received within the inlet central passage, allowing fluid from the fluid input to flow to the first and second chambers, and preventing flow from the first and second chambers to the fluid input during cam torque reversals;

wherein in the advance mode fluid is routed from the fluid input, through the inlet check valve to the advance working chamber and from the retard working chamber through the recirculation recess of the sleeve and the recirculation check valve to the advance working chamber.

3. The system of claim 2, wherein recirculation check valve comprises a plate, a spring retainer, a valve seat, and a spring with a first end attached to the plate and a second end attached to the spring retainer.

4. The system of claim 2, wherein the inlet check valve comprises a ball, a valve seat, a spring retainer, and a spring with a first end attached to the ball and a second end attached to the spring retaining member, wherein the ball blocks the flow of fluid through a passage connected to the inlet passage.

5. The system of claim 1, wherein the control valve is further moveable to a detent mode and wherein when the control valve is in the detent mode, the control valve blocks fluid from exiting from the retard working chamber through the control valve, retaining fluid within the retard working chamber, blocking the supply line to the first recess, such that the first lock pin engages the first recess of the housing assembly, locking the relative angular position of the housing assembly and the rotor assembly.

6. The system of claim 5, wherein when the control valve is moved to the detent mode, the second lock pin is moved to the unlocked position.

7. The system of claim 5, further comprising a detent circuit that is switchable from an open position to a closed position, wherein when the detent circuit is in the open position, the detent circuit moves the vane to an intermediate position within the at least one chamber defined by the housing assembly and the rotor assembly.

8. The system of claim 7, wherein when the detent circuit is in a closed position, the control valve is moved to the oil pressure actuated mode and fluid flows through the control valve to oil pressure actuate the advance and retard working chambers.

9. The system of claim 8, wherein when the detent circuit is open, fluid is allowed to flow between an advance detent line to at least one advance working chamber and a retard detent line to at least one retard working chamber and a common line in fluid communication with the advance working chamber and the retard working chamber with advance and retard check valves, such that the rotor assembly is moved through cam torque actuation of at least one advance working chamber and at least one retard working chamber and held in an intermediate phase angle position relative to the housing assembly.

10. The system of claim 8, wherein the detent circuit is switchable between the open position and the closed position through a piloted valve.

11. The system of claim 10, wherein the piloted valve further comprises a spool have a first end and second end, wherein the first end is the first lock pin and fits in the first recess.

12. The system of claim 1, wherein when the control valve is moved towards the advance mode, the retard mode, or the holding position, the first lock pin is moved to the unlocked position.

13. The system of claim 1, wherein the control valve further comprises an inlet check valve.

14. The system of claim 1, wherein the first recess is in an inner end plate of the housing assembly and the second recess is in an outer end plate of the housing assembly.

15. The system of claim 1, wherein the control valve is located remotely from the phaser.

16. The system of claim 1, further comprising a first lock pin spring for biasing the first lock pin towards the first recess and a second lock pin spring for biasing the second lock pin from away the second recess in the housing assembly.

* * * * *